US005499872A

United States Patent [19]

Baxter

[11] Patent Number: 5,499,872

[45] Date of Patent: Mar. 19, 1996

[54] TURNTABLE MIXER APPARATUS

[76] Inventor: Michael Baxter, 127-D Edgewater Park, Bronx, N.Y. 10465

[21] Appl. No.: 209,631

[22] Filed: Mar. 14, 1994

[51] Int. Cl.[6] ..... B01F 11/00

[52] U.S. Cl. ..... 366/213; 366/208

[58] Field of Search ..... 366/142, 208, 366/209, 210, 211, 213, 214, 601; 99/348

[56] References Cited

U.S. PATENT DOCUMENTS

| | | | |
|---|---|---|---|
| 2,793,010 | 5/1957 | Menken | 366/208 |
| 2,970,235 | 1/1961 | Pike | 366/211 X |
| 3,184,222 | 5/1965 | Aronowitz et al. | 366/209 |
| 3,430,927 | 3/1969 | Pouzar | 366/213 |
| 3,542,344 | 11/1970 | Oberhauser . | |
| 3,777,652 | 12/1973 | Engel | 366/214 X |
| 3,814,360 | 6/1974 | Samuelian, Sr. et al. | 248/131 |
| 3,891,171 | 6/1975 | Samuelian, et al. | 248/131 |
| 4,061,315 | 12/1977 | Eitzen et al. | 366/142 X |
| 4,212,546 | 7/1980 | Porteous | 366/213 |
| 4,293,643 | 10/1981 | Ohtake et al. | 366/142 X |
| 4,330,696 | 5/1982 | Pomeroy et al. . | |
| 4,479,720 | 10/1984 | Mochida et al. | 366/214 |
| 4,673,297 | 6/1987 | Siczek et al. | 366/208 |
| 4,702,610 | 10/1987 | Reynolds, Jr. | 366/213 |
| 4,981,801 | 1/1991 | Suzuki et al. | 435/290 |
| 4,985,128 | 1/1991 | Ebersole et al. | 204/182.8 |
| 5,013,158 | 5/1991 | Tarlow | 99/348 X |
| 5,066,135 | 11/1991 | Meyer et al. | 366/208 |

*Primary Examiner*—Charles E. Cooley

[57] ABSTRACT

A turntable mixer, for mixing a sample container, comprising a rotation mechanism, a cycle timer, and a speed controller. The rotation mechanism has a turntable disk for supporting the sample container, and a motor for rotating the turntable disk. The cycle timer has a time-on controller for adjusting a time-on interval, and a time-off controller for adjusting a time-off interval. The rotation mechanism is enabled during the time-on interval, and disabled during the time-off interval, the time-on interval and time-off interval are repeated indefinitely to create a mixing duty cycle. The rotation speed of the turntable disk is adjusted by the speed controller.

2 Claims, 1 Drawing Sheet

CYCLE TIMER
SPEED RPM
ON
OFF
TIMER
SPEED CONTROL
M
#1
#2
#N
MECHANICAL LINKAGE
MOTOR

TURNTABLE MIXER APPARATUS

BACKGROUND OF THE INVENTION

The instant invention is the subject matter of Disclosure Document No.: 331369, filed in the PTO on May 24, 1993, and it is respectfully requested that this document be retained beyond the two-year period so that it may be relied upon as evidence of conception of the invention during the prosecution phase of this application, should the need arise.

The invention relates to a turntable mixer method and apparatus, more particularly, the invention relates to a method and apparatus for mixing a sample at timed intervals.

In certain applications, it is desirable to have precise control over the mixing of the sample.

Conventional mixers, such as magnetic stirrers manufactured by the Cole-Parmer Instrument Company of Chicago, merely allow a user to control the speed of the mixing. They do not allow more precise control over the mixing cycle.

While these units may be suitable for the particular purpose employed, or to general use, they would not be as suitable for the purposes of the present invention as disclosed hereafter.

SUMMARY OF THE INVENTION

It is an object of the invention to provide a turntable mixer that can mix a substance for an adjustable period of time, then cease the mixing for an adjustable period of time before resuming mixing.

It is another object of the invention to provide a turntable mixer that will allow uniform mixing of a plurality of samples.

It is a further object of the invention to provide a turntable mixer that allows adjustment of the mixing speed.

A yet further object of the invention is to provide a turntable mixer or agitator that would be ideally suited for use in a laboratory to mix cells in liquid growth media, staining or destaining gels used in electrophoresis, or other application where gentle mixing is called for.

A still further object of the invention is to provide a turntable mixer suitable for use in a microwave oven for mixing and agitating foods or other substances directly by inducing a swirling action while they are being heated in the microwave oven.

The invention is a turntable mixer, for mixing a sample container, comprising a rotation mechanism, a cycle timer, and a speed controller. The rotation mechanism has a turntable disk for supporting the sample container, and a motor for rotating the turntable disk. The cycle timer has a time-on controller for adjusting a time-on interval, and a time-off controller for adjusting a time-off interval. The rotation mechanism is enabled during the time-on interval, and disabled during the time-off interval, the time-on interval and time-off interval are repeated indefinitely to create a mixing duty cycle. The rotation speed of the turntable disk is adjusted by the speed controller.

To the accomplishment of the above and related objects, the invention may be embodied in the form illustrated in the accompanying drawings. Attention is called to the fact, however, that the drawings are illustrative only. Variations are contemplated as being part of the present invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figures 1, 2, 3, 4, 5, 6, 7, 8:
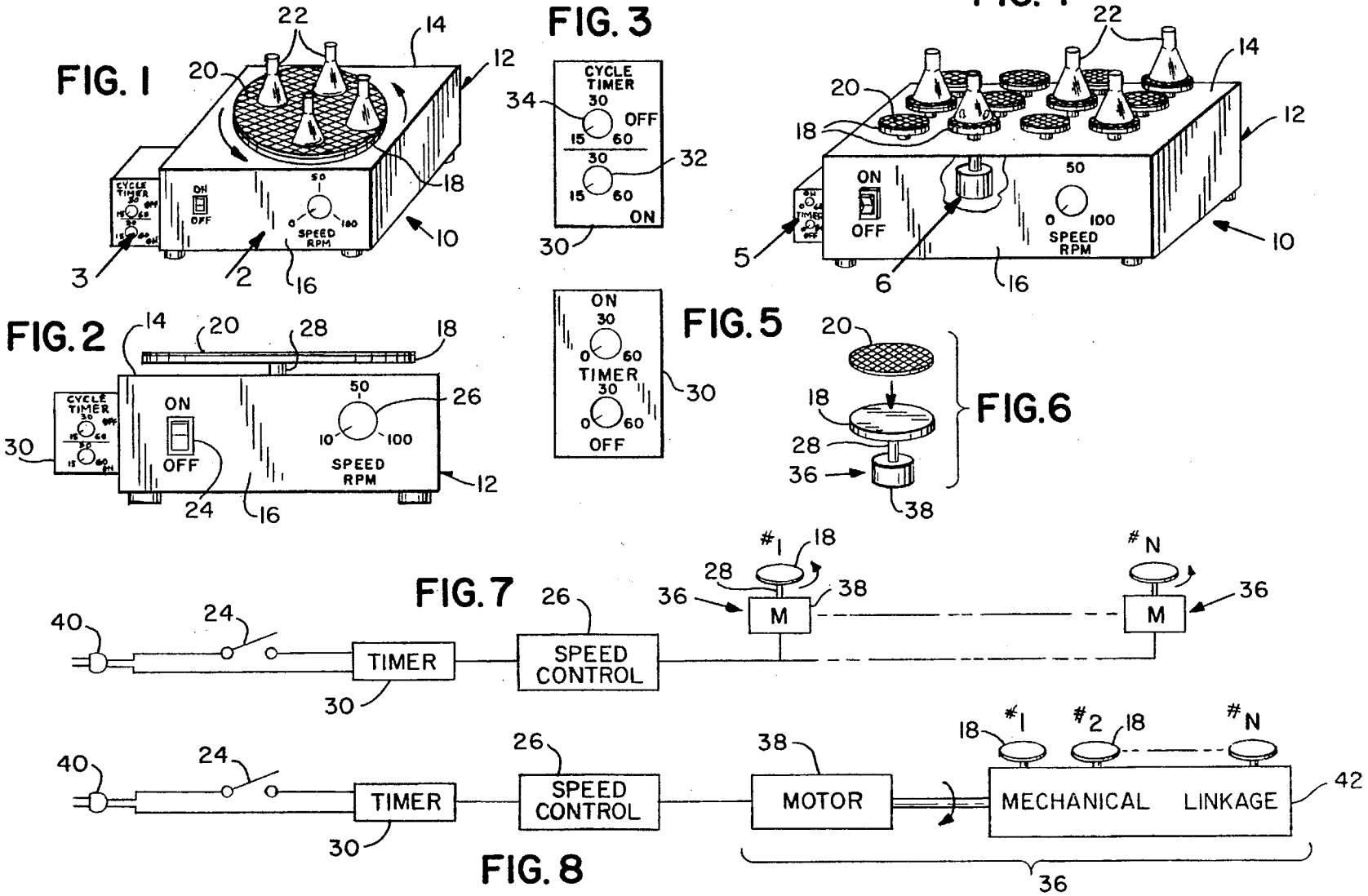
FIG. 1 is a diagrammatic perspective view of a first embodiment of the instant invention.
FIG. 2 is an elevational view taken in the direction of arrow 2 in FIG. 1.
FIG. 3 is an enlarged elevational view, with parts broken away, taken in the direction of arrow 3 in FIG. 1.
FIG. 4 is a diagrammatic perspective view of a second embodiment of the instant invention, with parts broken away.
FIG. 5 is an enlarged elevational view with parts broken away, taken in the direction of arrow 5 in FIG. 4.
FIG. 6 is an enlarged exploded view, taken generally in the area of arrow 6 in FIG. 4.
FIG. 7 is a diagrammatic block diagram of the second embodiment, utilizing more than one motor.
FIG. 8 is a block diagram of the second embodiment, utilizing a single motor and a mechanical linkage.

FIG. 1 illustrates a turntable mixer 10. The turntable mixer 10 has a base 12, the base 12 having a base top surface 14, and a base front panel 16. A turntable disk 18 is mounted at the base top surface 14, and is substantially parallel to the base top surface 14. The turntable disk 18 rotates in a horizontal plane, at a rotation speed, as indicated by the opposed arrows adjacent to the turntable disk 18 in FIG i.

The turntable disk has a skid resistant pad 20 that has a multicellular surface for preventing objects from shifting on the turntable disk 18 while it is gently rotating.

A plurality of sample containers 22 are resting on the skid resistant pad 20 on the turntable disk 18. The sample containers 22 supported by the turntable disk 18 are herein illustrated as erlenmeyer flasks.

FIG. 2 details the base front panel 16. The base front panel has an on/off switch 24 to provide power to the apparatus, and a speed control 26 to vary the rotational speed of the turntable disk 18.

A shaft 28 connects the turntable disk 18 to inside the base 12 through the base top surface 14.

The apparatus further has a cycle timer 30 for creating a mixing duty cycle, wherein the rotation of the turntable disk is repetitively switched on and off.

Referring to FIG. 3, the cycle timer 30 has a time-on controller 32, and a time-off controller 34. The time-on controller 32 adjusts the length of a time-on interval. The time-off controller 34 adjusts the length of a time-off interval.

The operation of the cycle timer 30 is summarized as follows: The cycle timer enables the turntable disk 18 to rotate during the time-on interval, as set by the time-on controller 32. At the end of the time-on interval, the turntable disk 18 disables the rotation of the turntable disk 18. The turntable disk 18 does not rotate during the time-off interval, as set by the time-off controller 34. At the end of the time-off interval, the turntable disk 18 will once again rotate for the time-on interval.

The mixing duty cycle comprises an automatic, indefinite repetition of the time-on interval and time-off interval.

This mixing duty cycle provides delicate mixing to samples of various types. For example the turntable mixer can be used in a laboratory to a mix cells in liquid growth media, staining or destaining gels used in electrophoresis gels, or any other application where gentle mixing is desirable.

In addition to its laboratory uses, the turntable mixer may used in cooking to mix food at intermittent intervals. For example, microwave ovens can be equipped with a turntable mixer to create a swirling or mixing action in foods at periodic intervals.

FIG. 4 illustrates a second embodiment of the turntable mixer 10, wherein several turntable disks 18 are mounted on the base top surface 14, each turntable disk 18 for mixing a sample container 22.

FIG. 5 illustrates another visual embodiment of the cycle timer 30, similar to FIG. 3.

FIG. 6 details a rotation mechanism 36, comprising a motor 38, the turntable disk 18 attached to the motor by the shaft 28, and the skid resistant pad 20 atop the turntable disk 18.

FIG. 7 is a diagrammatic block diagram, illustrating the apparatus of the present invention. The cycle timer 30 is supplied electricity, through the on/off switch 24, by a power cord 40. The cycle timer 30 selectively supplies power to the rotation mechanism 36 through the speed control 26.

In the embodiment illustrated in FIG. 7, several rotation mechanisms 36 each have their own motor 38 attached to their turntable disk 18 with the shaft 28.

In another embodiment illustrated in FIG. 8, a single rotation mechanism 36 employs a single motor 38, attached to several turntable disks 18 through a mechanical linkage 42.

The invention claimed is:

1. A turntable mixer for mixing a substance consisting of:

a) a turntable disk which is attached to a motor, said turntable disk being capable of supporting a sample container containing said substance, said motor causing the turntable disk to rotate in a horizontal plane;

b) a cycle timer having a time-on controller adjusting a time-on interval enabling the turntable disk to rotate and a time-off controller for adjusting a time-off interval disabling rotation of the turntable disk, said cycle timer creating a repeated time-on interval and time-off interval to create a mixing cycle;

c) a speed control for controlling the rotation speed of the turntable disk; and d) a skid resistant pad atop the turntable disk.

2. The apparatus of claim 1 wherein the turntable disk is attached to the motor by a shaft.

* * * * *